US006164867A

United States Patent [19]

Sherwin

[11] Patent Number: 6,164,867

[45] Date of Patent: Dec. 26, 2000

[54] EROSION RETARDATION STRUCTURE

[76] Inventor: Frederick S. Sherwin, 2400 S. Ocean Dr. #C1224, Ft Pierce, Fla. 34949

[21] Appl. No.: 09/384,871

[22] Filed: Aug. 27, 1999

[51] Int. Cl.[7] ..... E02B 3/04; E02D 5/18

[52] U.S. Cl. ..... 405/15; 405/16; 405/21; 405/31; 405/258; 405/284

[58] Field of Search ..... 405/15, 16, 20, 405/21–31, 73, 74, 284, 285, 286, 258

[56] References Cited

U.S. PATENT DOCUMENTS

| | | | |
|---|---|---|---|
| 1,361,831 | 12/1920 | Crew | 52/281 |
| 3,490,239 | 1/1970 | Vincent | 405/31 |
| 3,732,653 | 5/1973 | Pickett | 52/71 |
| 3,820,343 | 6/1974 | Morren et al. . | |
| 3,953,976 | 5/1976 | Morren et al. . | |
| 4,138,947 | 2/1979 | Pickett . | |
| 4,363,432 | 12/1982 | Conover | 405/15 X |
| 4,784,521 | 11/1988 | Martin et al. | 405/28 |
| 4,818,141 | 4/1989 | Rauch | 405/31 X |
| 5,039,250 | 8/1991 | Janz | 405/15 |
| 5,176,468 | 1/1993 | Poole | 405/23 |
| 5,267,812 | 12/1993 | Suzuki et al. | 405/15 X |
| 5,536,111 | 7/1996 | Doernemann | 405/16 |
| 5,622,448 | 4/1997 | Baum et al. | 405/15 |
| 5,924,820 | 7/1999 | Creter | 405/25 |

*Primary Examiner*—Eileen D. Lillis
*Assistant Examiner*—Jong-Suk Lee
*Attorney, Agent, or Firm*—Malloy & Malloy, P.A.

[57] ABSTRACT

An erosion retardation structure to reduce erosion of an underlying granular base at a coastal property, the structure including a plurality of generally rigid material panels, each having a first end, second end, first face and second face, and structured to be coupled to an adjacently disposed panes at generally their corresponding first and second ends so as to define a wall section wherein a first face of a first panel and a second face of a second panel are positioned relative to one another so as to define a front face of the wall section. Defined generally at coupled first and second ends of the adjacently disposed panels is a coupling assembly which secures the panels at a predetermined angular orientation of generally between about 75–115 degrees relative to one another, and at a predetermined angular vertical orientation relative to a horizontal plane of the underlying granular base so as to define a rearwardly sloped configuration of the panels relative to an oncoming movement of a wave of fluid, and so as to disburse and disrupt the wave of fluid engaging the front face of the wall section so as minimize a scouring and eroding effect of the wave of fluid on the underlying granular base, thereby promoting a deposit of granular material in generally adjacent proximity to erosion retardation structure.

18 Claims, 2 Drawing Sheets

EROSION RETARDATION STRUCTURE

BACKGROUND OF THE INVENTION

1. Field of the Invention

The present invention relates to an erosion retardation structure and method of forming same, which can be efficiently and effectively positioned on a coastal area susceptible to beach erosion under the impacts of wind and surf so as to minimize the rate at which erosion occurs and so as to achieve an economical and effective replenishing of beach front property in a system which can be quickly erected, with minimal labor and material expenditures, and which can be utilized to construct a temporary or substantially permanent structure which retards the erosion on a continuous basis.

2. Description of the Related Art

In virtually all coastal properties throughout the world, a primary concern of municipalities and private land owners alike is the continuing erosion of the coastal beaches and the loss of valuable property to the ocean. A main reason for this severe rate of erosion naturally relates to the movement of the wind and surf over the beach front property, continuously dislodging sand and removing it from the beach.

In many locations, the extent of the beach front erosion has become very severe, and areas which originally had large expansive beaches are continuously being narrowed requiring pro-active measures be taken. For example, traditionally the problems associated with beach erosion have been countered by pumping sand from the ocean bottom onto the beaches, thereby replenishing the sand that has been lost to a period of erosion. As one can appreciate, however, the process of dredging up sand from deep ocean areas, and pumping that sand, often over long distances, to the desired beach front property can be very complex, costly, time consuming, and can conspicuously detract from the overall attractive appearance of the beach front property for an extended period of time. Moreover, some studies show that due to the extended rate of erosion in some areas, such replenishing procedures often lend themselves to a continuing cycle because the beaches erode once again after just a few years. Accordingly, for a long stretches of beach, when the expensive process of sand pumping is completed over the entire length of the beach, a relatively short time thereafter the costly pumping process must begin anew. As a result, the expensive, large scale and unattractive pumping processes, including the large pumping conduits and heavy machinery, are present on the beach front property for a long period of time, and a true long term solution is not achieved.

In addition to those known pumping procedures for directly replenishing lost sand on the beach front property, others have attempted to construct wall structures in an effort to minimize the rate of erosion. Unfortunately, however, currently existing wall structures generally provide merely standard rigid, vertical walls, in either straight or zigzag patterns, so as to retain a quantity of sand on the inland side thereof and block the flow of the surf. Such vertical wall structures, however, do not effectively provide for the build up of sand on the beach front property, and indeed can promote an increased scouring action by the waves which strike the vertical walls. Specifically, as the waves strike the vertical wall structures, a large quantity of the water tends to be directed down into the surface of the sand, loosening and picking up even greater quantities of the sand than would normally have been picked up. As a result, although the walls may retain a certain amount of sand on an inland side thereof and may moderately restrict the flow of waves, the increased scouring action which results from waves striking the surface actually promotes erosion of the beach front property, at least on a water front side of the walls, thereby effectively countering any benefit to be derived therefrom and resulting in a loss of dry sand beach.

In addition to the operational deficiencies of known vertical wall structures, yet another draw back associated therewith involves the substantial construction costs, in both materials and man hours, associated with the fabrication transport and installation of an extended stretch of wall. For example, vertical walls are typically formed from slabs of precast concrete. As a result, the individual slabs must be transported to the beach front property and/or cast on site using heavy duty steel forms, and must be effectively secured at a desired location in the ground. Because of the extent of erosion, however, and because of the heavy winds which are traditionally present at coastal areas, the walls must be anchored substantially deep into the underlying surface in order to prevent tipping or wobbling under the constant pressure of wind and surf. Naturally, such construction and installation requirements can lead to substantially increased costs, both as a result of materials and labor, as well as a result of the time that it takes to effectively erect the wall structures.

Accordingly, there is a substantial need in the art for an erosion retardation system which reduces beach erosion resulting from wind and surf washing up on shore, and which actually functions to build up the beach front property without costly and cumbersome pumping process. Furthermore, such an improved system should be capable of secure and cost effective installation, in either a temporary or permanent form, and with minimal labor and time requirements.

SUMMARY OF THE INVENTION

The present invention relates to an erosion retardation structure configured to reduce erosion on an underlying granular base, such as sand, by reducing the loss of the granular base as a result of surf and wind and/or by building up the granular base so as to counter the effects of erosion which do take place.

The erosion retardation structure of the present invention includes a plurality of generally rigid material panels, each including a first end, a second end, a first face, and a second face. In order to define preferably a plurality of wall sections, each adjacently disposed pair of panels are further structured to be secured with one another, such as by coupling the first and second ends of the adjacent panels with one another.

In order to achieve effective securement of the panels with one another, and so as to define the desired configuration of the erosion retardation structure, a coupling assembly is defined, preferably generally at the first and second ends of the adjacent panels. The coupling assembly is structured to secure the adjacently disposed panels at a predetermined angular orientation relative to one another. Preferably, the predetermined angular orientation is approximately 90 degrees so as to generally disrupt the movement of waves of fluid, including water and wind. Furthermore, the coupling assembly is structured to secure the adjacently disposed panels at a predetermined angular vertical orientation relative to a horizontal plane of the underlying granular base. As a result, the predetermined angular vertical orientation of each wall section defines a rearwardly sloped configuration of the panels relative to an oncoming movement of inland waves of fluid.

The plurality of wall sections defined by the secured, adjacent material panels are structured to be disposed along a coastal area so as to be engaged by the oncoming, inland movement of fluid waves. As a result of the sloped configuration and general zigzag pattern of the wall sections, however, the waves of fluid tend to be disbursed and disrupted as they engage the front face of the wall sections. This disbursement and disruption of the fluid wave functions to minimize the scattering and scouring erosion effect of the waves of fluid and also promotes the deposit of granular materials being carried by the waves of fluid in generally adjacent proximity to the panels, such as along the rear face on an inland side of the material panels. For example, based at least in part on the sloped configuration achieved by the coupling assembly and the structure of the panels, the waves of fluid are not entirely blocked by the wall sections, but are permitted to pass over the wall sections, at least to a certain extent. When, however, the waves of fluid pass over the wall sections, and indeed, when the surf washes back out into the body of water, the disbursement and disruption of the flow pattern tends to release quantities of the granular material which had been picked up by the wave of fluid and would normally have been deposited elsewhere leading to increased erosion.

These and other features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Shown throughout the Figures, the present invention is directed towards an erosion retardation structure, generally indicated as 10, as well as a mold assembly 70 for effectively molding an embodiment of the erosion retardation structure 10. Moreover, as will become apparent subsequently, one embodiment of the erosion retardation structure 10 can indeed function as at least a portion of the mold assembly 70, of FIG. 4 of the present invention during the formation of another embodiment of the erosion retardation structure 10.

Looking in particular to the erosion retardation structure 10, it includes a plurality of generally rigid material panels 30 and 30'. In the preferred illustrated embodiment, the individual panels 30 and 30' preferably includes a height of approximately two feet and a width of approximately ten feet such that each two panel wall section covers generally about 13 feet of shoreline. Of course, however, it is understood that the ultimate dimension of each of the panels 30 and 30' may vary greatly depending upon the needs of a particular location, and indeed the ultimate number of panels 30 and 30' which will be utilized will depend on the overall distance to be covered by the erosion retardation structure 10 of the present invention. Further, although it is recognized that the preferred material construction of the individual panels may be sheet metal and/or concrete, is recognized that a variety of other preferably at least partially rigid material panels may be equivalently constructed, such as of a hardened molded plastic material or other molding materials. Further, the degree of rigidity can also vary depending upon the nature of the material itself and the installers desire to include more or less support assemblies, as will be described, so as to reinforce the panels 30 and 30' under the constant impact of waves of fluid, including water and wind.

Figure 2:
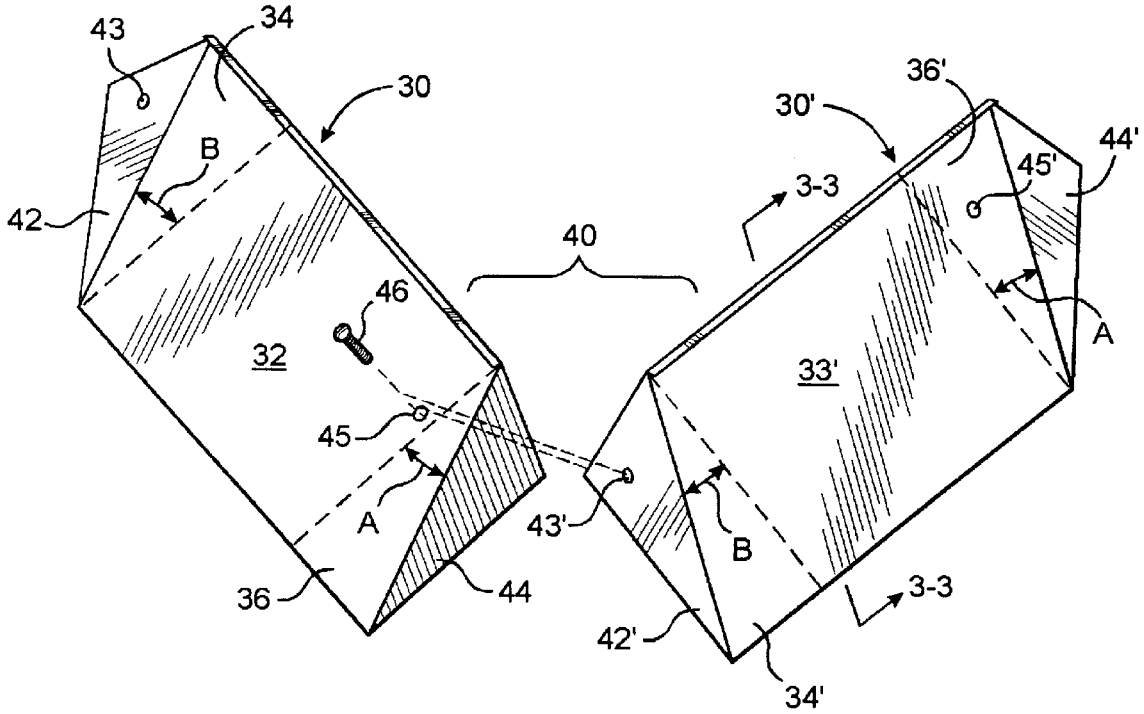
FIG. 2 is an exploded view of a wall section of the erosion retardation structure of the present invention.

Each of the panels 30 and 30' of the present invention includes a first end, generally 34, 34', a second end, generally 36, 36', a first face, 32, 32', and a second face, 33, 33'. Moreover, adjacently disposed ones of the panels, such as a first and a second adjacently disposed panels 30 and 30' are coupled with one another at generally their corresponding first and second ends 36 and 34' so as to generally define a wall section, generally 20. In particular, for the purposes of clarity and ease of description, each wall section 20 is defined as two adjacent panels 30 and 30'. It is, however, understood that a plurality of wall sections 20, each with adjacent panels being secured with one another is preferably utilized to ultimately form the erosion retardation structure 10. Moreover, in the illustrated embodiment, the coupled engagement is generally achieved at the second end 36 of the first panel 30 and the first end 34' of the second panel 30', however, it is recognized that the opposite ends 34 and 36' of the first and second panels 30 and 30' will correspondingly be secured to the corresponding ends of other adjacent panels, not shown in FIG. 2 for clarity. As a result, the configuration of the coupling assembly to be described will preferably likewise apply to these ends as well. Additionally, as best seen in FIG. 2, the panels 30 and 30' preferably include substantially equivalent configurations, however, so as to define the desired configuration of the erosion retardation structure 10, the first and second panels 30 and 30' are disposed relative to one another such that the first face 32 of the first panel 30 and the second face 33' of the second panel 30' define a front face of the wall section 20 which is generally on the sea side of the erosion retardation structure 10.

Figure 1:
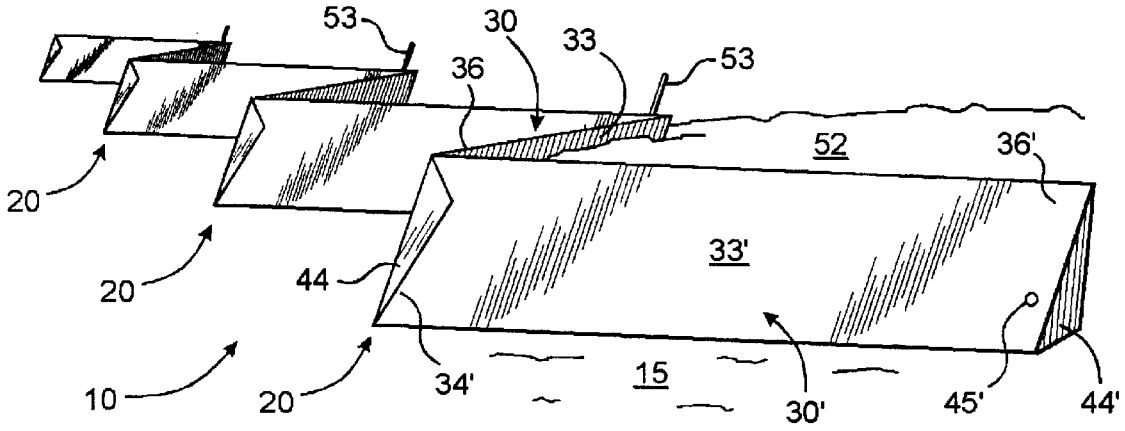
FIG. 1 is a perspective illustration of the erosion retardation structure of the present invention operatively positioned.

Defined generally at the coupled ends of the adjacently dispose panels 30 and 30' is a coupling assembly, generally indicated as 40. Specifically, the coupling assembly, which also includes at least a portion of the panels themselves, is configured to secure the adjacently dispose panels 30 and 30' with one another at a predetermined angular orientation relative to one another, and at a predetermined angular vertical orientation relative to a horizontal plane of the underlying granular base 15, seen in FIG. 1, on the which the erosion retardation structure 10 is positioned. To further elaborate, in the illustrated embodiment and so as to facilitate proper and aligned positioning, the coupling assembly 40 preferably comprises mating folds 42, 42' and 44, 44' disposed at the first and second ends 34, 34' and 36, 36', respectively, of the panels 30 and 30'. In this regard, the mating fold 44 disposed generally at the second end 36 of the first panel 30 is generally coupled with the second panel 30' in overlying or other preferred close proximity with the mating fold 42' disposed at the first end 34' of the second panel 30' . As best seen with regard to FIGS. 1 and 2, in the illustrated embodiment the mating folds 44 and 42' preferably do not directly confront one another, but rather confront corresponding portions of the main faces of the first and second panels 30 and 30' at the coupled first and second ends 34' and 36. Also in the illustrated embodiments, mating apertures 45 and 43 are preferably defined in the first and second panels 30 and 30' so as to receive a preferably removable fastener element 46, such as screw, rivet, nut, bolt, weld, clip, clamp, adhesive, strapping, etc., which can effectively secure the adjacent panels 30 and 30' with one another. The illustrated embodiment wherein a single fastener element 46 is used at each coupling assembly is typically preferred, as such the configuration facilitates rapid installation, and permits a degree of adjustability between the panels, such as to compensate for an uneven underlying granular base.

Looking in further detail to the mating folds 42, 42' and 44, 44' disposed on each of the panels 30, 30', they are preferably defined in opposing angled orientations from one another relative to the vertical plane of the particular panel. Specifically, and as seen with regard to FIG. 2, the mating fold 42 on one end of the panel 30 will be formed in a direction opposite the mating fold 44 on the opposite end of the panel 30. It is, however, recognized that this opposing direction of the mating folds is achieved primarily to permit a uniform construction of all of the panels and to provide a generally intermeshed configuration between adjacent panels wherein each panel will define an external point of the coupling assembly at one end thereof, while also defining an interior point of the coupling assembly at an opposite end. Such a configuration, although not required, is generally preferred as being more stable over a length of the erosion retardation structure 10.

Preferably primarily as a result of the specific position and orientation of these mating folds 42, 42' and 44, 44', which generally guide the securement orientation between the panels 30, 30', the desired predetermined angular orientation of the panels 30 and 30' relative to one another and the predetermined angular vertical orientation of the panels 30 and 30' relative to a horizontal plane of underlying granular base 15 are generally achieved when the panels 30, 30' are securely coupled with one another. In the preferred embodiment, the opposing angles which define the orientations of the mating folds relative to the vertical plane of the panels are generally between about 15–45 degrees from vertical, as defined by angles A and B in the figures. In the illustrated preferred embodiment, the angles are preferably about 25 degrees from vertical, and accordingly, 65 degrees from horizontal.

When the panels 30 and 30' are secured with one another utilizing the mating folds 42' and 44, as general guides, the predetermined angular vertical orientation of the panels 30 and 30' defines a generally rearwardly sloped configuration for each panel of the wall section 20, relative to an oncoming movement of the wave of fluid, be it water or wind. In the illustrated embodiment, and as best seen with regard to FIGS. 3 and 4, the predetermined angular vertical orientation relative to the horizontal plane of the underlying granular base 15 is generally about 50 degrees to 80 degrees from horizontal, Moreover, in the illustrated embodiment as referenced by the angle C, the angular vertical orientation is preferably defined at about 65 degrees from the horizontal plane of the underlying granular base 15. As a result of this generally sloped angular vertical orientation, each wave of fluid engaging the front face of the wall section 20 will generally be dispersed and disrupted in a way that minimizes scouring and erosion effects on the underlying granular base 15. For example, it is noted that with generally vertical wall structures a scouring effect tends to take place as a result of the direct impact of a wave of fluid on the wall and the normal direction of large volumes of water down into the underlying granular base 15. Due to the angular vertical orientation of the present invention which defines the generally rearwardly sloped configuration, the flow is disrupted and disbursed in a manner which does not generally direct the flow path down into the underlying granular base 15, thereby minimizing scouring. Furthermore, the rearwardly sloped configuration actually allows at least a certain quantity of the fluid wave to pass over an upper edge of the wall section 20 and defines a capture zone along a rear face thereof. Additionally, as a result of the passage of the fluid wave over the upper edge of the wall section 20, both in a forward and a reverse direction as a result of the return of surf, a deposit of granular material, preferably sand, is generally promoted in adjacent proximity to the panels 30 and 30' and preferably, at each face of the panel. Indeed, it is noted that after extended periods of use of the panels, a substantial build up of the granular material base 15 is exhibited, and at some point, the panels 30 and 30' may actually become covered completely so as to define a sand dune or a further portion of the granular material base. Indeed, this covering can take place naturally and/or by pumping in some circumstances. Moreover, a series of the erosion retardation structures 10 of the present invention can ultimately be positioned in generally staggered relation with one another so as to promote sand buildup along not only a length of the beach, but also along a width of the beach.

Additionally, and as previously recited, the coupling assembly 40 preferably defines a predetermined angular orientation of the panels relative to one another. The predetermined angled orientation of the panels relative to one another is generally defined by a degree of the mating folds relative to a plane of the individual panels 30 and 30'. In the preferred embodiment, the predetermined angular orientation of the panels relative to one another is generally between about 75 to 115 degrees, and in the illustrated embodiments, is 90 degrees. Such an angular orientation of the panels relative to one another further promotes the disruption and dispersement of the wave of fluid confronting the front face of the wall sections 20, thereby also slowing the erosion process and promoting the buildup of sand in adjacent proximity to the wall sections 20.

Figure 3:
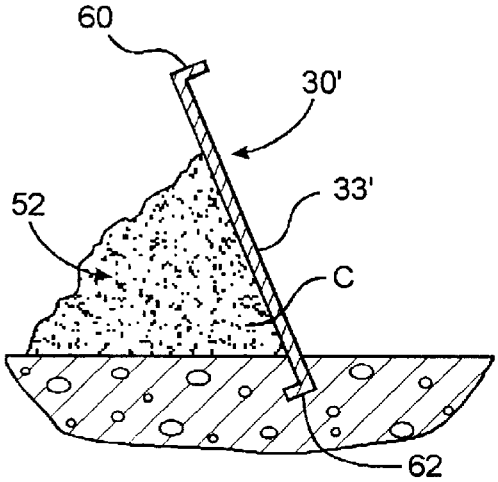
FIG. 3 is a cross section view of a panel of the present invention illustrating the sloped configuration and an embodiment of the support assembly.

With particular reference to FIG. 3, the erosion retardation structure 10 of the present invention, also preferably includes a flange assembly 60 disposed at generally an upper edge of the wall section 20, and in particular, at the upper edge of each panel 30 and 30'. The flange assembly 60 is preferably positioned so as to further disrupt a flow of the wave of fluid over the wall section 20. For example, as a wave of fluid, and in particular a water wave passes over the wall section 20, the flange assembly 60 of the illustrated embodiment is positioned so that the flow is further disrupted and such that granular materials which are generally contained in the flow of fluid are released and are dropped in adjacent proximity to the panels 30 and 30'. In this regard, the flange assembly 60 may include a solid material construction defined as part of the panels 30, 30' themselves and/or may include a meshed, segmented, or other erratic configuration formed or otherwise positioned directly at the top of upper edge of the panels 30 and 30' or at a portion of the upper edge preferably somewhat near the top of the panels 30 and 30'. Furthermore, it is also recognized that the flange assembly 60 also reduces the presence of a potentially hazardous sharp edge at the upper edge of the wall sections 20, thereby making the assembly safer.

In order to provide ease of manufacture, as well as to further secure the panels 30 and 30' within the underlying granular base 15 without having to dig into the underlying granular base, a flange assembly 62 is also preferably positioned generally at a lower edge of the wall section 20. This flange assembly 62 provides a larger surface area base which reduces the tendency of the panels to sink over an extended period of time. Also, if desired, the flange assembly 62 provides a surface atop which a hardened material footing or quantities of the granular material base 15 can be positioned so as to maintain a general secure positioning of the panel 30 and 30' in a desired location within the granular base 50. Along these lines, however, it is noted that primarily because of the extent of the angular vertical orientation of the panels 30 and 30', as well as the repeated impacts which are exhibited as a result of the fluid waves, the panels 30, 30' may be susceptible to tipping further towards the underlying granular base 15 and/or sinking. The flange assembly 62 tends to counter this pivoting or tipping under the weight of the panels and the impacts by the fluid waves on the front face of the wall sections 20.

Also at least partially because of the rearwardly sloped configuration and the impact of incoming fluid waves, it may also be preferable to provide a further support assembly to prevent a rearward collapse of the panels 30 and 30' after extended periods of use, either into a flat engagement with the granular base 15 and/or a diminishing of the desired angular vertical orientation. The support assembly may be positioned periodically along each panel 30 and 30', and depending upon the needs of the installer, the construction of the panels, and/or the conditions of an installation location, one or more support assemblies may be positioned at each wall section or each individual panel. Looking to FIGS. 1 and 3, in the illustrated embodiment, the support assembly may comprise a quantity of granular material 52 piled up in adjacent, abutting engagement between a rear face of the wall section 20 and the underlying granular base 15. This additional quantity of granular material can be hardened, if desired, however, preferably due to the generally concealed nature that results from the position and orientation of the panels 30 and 30', a buildup of granular material 52 as the support assembly will generally not be susceptible to significant erosion and will provide a secure long lasting support for the wall section 20. Preferably this build up of granular material 52 can extend as far as ten or more feet behind the surface of the panels, thereby also promoting safety and an even build up. It is of course recognized that if desired, the support assembly may include a rigid support element disposed between the panel and the underlying granular base. In either configuration, the support assembly provides a secure collapse resistant support, while also maintaining the desired angular vertical orientation of the panels. Additionally, however, the support assembly may also be configured to prevent a back flow of fluid from dislodging the panels. In this regard, the support assembly may include a preferably rigid rods 53, as in FIG. 1, or like element that extends generally along the front face of the wall section, such as at each interior corner or coupling area, and passes into the underlying granular base.

As previously indicated, the erosion retardation structure 10, and in particular, the panels 30 and 30' may be formed of a variety of materials, including sheet metal, concrete or another generally rigid preformed or molding material. In the sheet metal embodiment, substantially rapid installation with very few workers can generally be achieved due to the substantially lightweight nature of the sheet metal panels and the ease of securement that is possible. As a result, the panels 30 and 30' formed of sheet metal can be utilized as a highly cost effective and very rapid implementation to minimize erosion. It is, of course, recognized that in some instances a more permanent structure may be desired for erosion retardation purposes. In such a circumstance it is preferred that the panels be formed of a more solid material such as concrete. In such a concrete embodiment, the coupling assembly will include molded formed joints equivalent in shape to the secured mating folds, with the panels 30, 30' being generally integrally formed with one another for effective securement.

Figure 5:
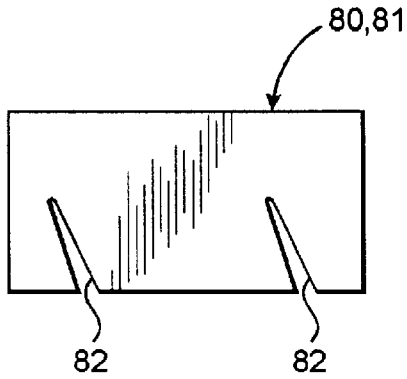
FIG. 5 is an isolated view of a brace assembly that may be used with the mold assembly of the present invention.
Figure 4:
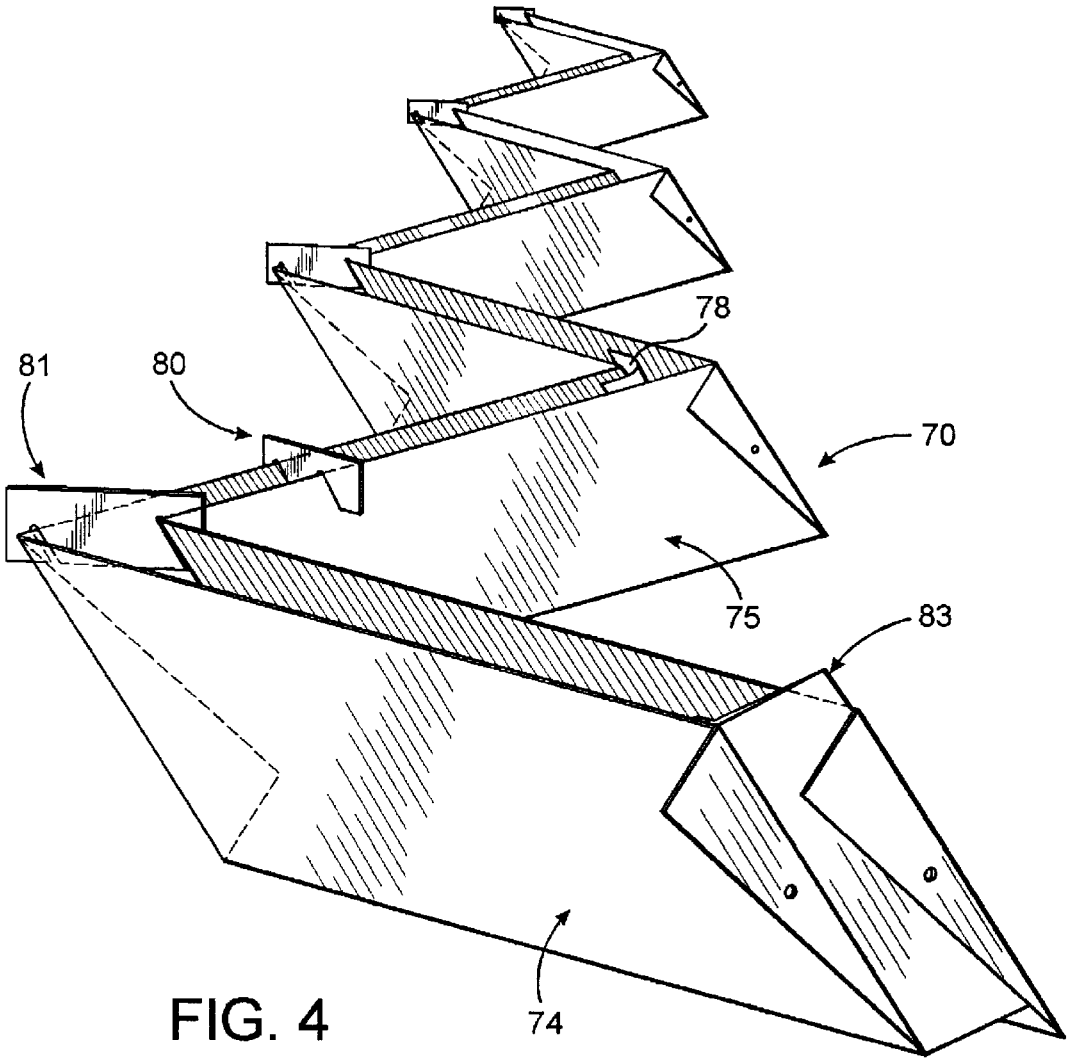
FIG. 4 is a perspective view of the erosion retardation structure mold assembly of the present invention.

Turning to FIGS. 4 and 5, in the embodiments of the erosion retardation structure 10 wherein a concrete or other poured, molding material construction is preferred, the present invention is further directed towards a corresponding mold assembly, generally 70. The mold assembly 70 is preferably comprised primarily by a leading face assembly 74 which is on the sea side, and a trailing face assembly 75, which is generally on the inland side. The leading face assembly 74 and the trailing face assembly 75 are preferably disposed a spaced apart distance from one another so as to receive a quantity of a molding material therebetween and effectuate proper hardening of the molding material into at least the panels of the erosion retardation structure 10. Preferably, at least the leading face assembly 74 of the mold assembly 70 is defined substantially by an aforementioned erosion retardation structure 10 formed of sheet metal or another generally lightweight material. As a result, the desired contour and configuration is generally achieved for the molded erosion retardation structure as well. Furthermore, although the trailing face assembly 75 may include any of a variety of configurations, including straighter or alternative configurations, in the illustrated embodiment, the trailing face assembly 75 is also preferably formed from one or more wall sections of the aforementioned erosion retardation structure formed of a lightweight material such as sheet metal. As a result, the molded erosion retardation structure generally achieves a corresponding, yet thicker configuration relative to the lighter weight sheet metal erosion retardation structure, and is generally a more permanent structure.

Because of the generally rearwardly sloped configuration that is generally achieved by the leading and trailing face assemblies 74 and 75 of the molding assembly 70, a support assembly, much like that used to support the erosion retardation structure 10 itself or formed as part of the panels themselves may be provided at least with regard to the trailing face assembly 75. Furthermore, the mold assembly also preferably includes one or more brace assemblies 80, 81. Specifically, the brace assemblies 80, 81 are structured to extend from at least some of the panels 30, 30' of the leading face assembly 74 to corresponding, generally confronting panels of the trailing face assembly 75, and function to maintain the spaced apart distance of the leading and trailing face assemblies 74 and 75 relative to one another. Each of the brace assemblies 80, 81 preferably includes at least two spaced apart slots 82 defined therein. The spaced apart slots are structured to receive an upper edge of the confronting panels of the leading and trailing face assemblies 74 and 74', thereby effectively functioning to maintain the desired spacing at least generally at the upper edges of the leading and trailing face assemblies 74 and 75. The precise shape of the brace assemblies 80, 81 and the corresponding slots 82 will be such as to provide for effective securing at a designated location, such as at the corner or coupling region, or at a central region of the panels. It is noted that a general secure positioning within the underlying granular base 15 can generally achieve effective spacing at the lower edge of the leading end trailing face assemblies 74 and 75. Of course, however, additional brace structures may be interposed directly in the gap between the leading and trailing face assemblies 74 and 75 to provide further security and maintain the effective spacing. Likewise, a plurality of reenforcing element 78, such as in the form of rigid material rods, can be disposed between the leading and trailing face assemblies 74 and 75 so as to be embedded in the molding material upon hardening thereof, and provide further reinforcement to the ultimately formed erosion retardation structure. A re-bar type structure may be effectively used in this context as the reinforcing elements 78. Also, one or more end caps 83 can be provided to sufficiently enclose the molding area.

As a result, utilizing the described mold assembly 70, best seen in FIG. 4, substantially rapid on site formation of a rigid more permanent erosion retardation structure can be effectively achieved. Once the molding material has hardened, the leading and trailing faces assemblies 74 and 75 may be disassembled by detaching the adjacent panels 30 and 30' from one another, thereby allowing the panels 30 and 30' to be utilized for further molding of the erosion retardation structure or another structure. As a result, a continuing sequence wherein short stretches of an erosion retardation structure or molded at a time can be achieved with only a small number of panels 30 and 30', but still ultimately resulting in a long erosion retardation structure to correspond the installation location.

It is noted, that within the context of the present invention, the term molding may include casting, forming, molding or any other like process wherein a solid structure is created based upon a defined mold or form.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. To reduce erosion of an underlying granular base, an erosion retardation structure comprising:

(a) a plurality of generally rigid material panels;

(b) each of said panels including a first end, a second end, a first face and a second face;

(c) adjacently disposed ones of said panels being coupled with one another at generally said first and said second ends thereof so as to define a wall section;

(d) a coupling assembly defined generally at said first and said second ends of said adjacently disposed one of said panels;

(e) said coupling assembly being structured to secure said adjacently disposed panels at a predetermined angular orientation relative to one another and a predetermined angular vertical orientation relative to a horizontal plane of the underlying granular base; and (f) at least said predetermined angular vertical orientation of said panels structured to disburse and disrupt a wave of fluid engaging a front face of said wall section, so as to minimize a scouring and eroding effect of said wave of fluid on the underlying granular base, and so as to promote a deposit of granular material by said wave of fluid in generally adjacent proximity to said panels.

2. An erosion retardation structure as recited in claim 1 wherein a first face of a first of said adjacently disposed panels and a second face of a second of said adjacently disposed panels define said front face of said wall section.

3. An erosion retardation structure as recited in claim 2 wherein said coupling assembly comprises a mating fold disposed at said first and said second ends of said adjacently disposed ones of said panels.

4. An erosion retardation structure as recited in claim 3 wherein said mating folds disposed at said first and said second ends of each of said panels are defined in opposing angled orientations from one another relative to a vertical plane of said panel so as to define said predetermined angular vertical orientation of said panels upon said mating folds of said adjacent panels being secured with one another.

5. An erosion retardation structure as recited in claim 4 wherein said opposing angled orientations of said mating folds relative to said vertical plane is generally between about 15–45 degrees from said vertical plane.

6. An erosion retardation structure as recited in claim 4 wherein said coupling assembly further comprises at least one removable fastener element extending through at least one of said mating folds so as to secure said panels with one another.

7. An erosion retardation structure as recited in claim 6 wherein said coupling assembly comprises a single one of said removable fastener elements so as to permit relative pivotal movement between said adjacently disposed panels.

8. An erosion retardation structure as recited in claim 1 wherein said predetermined angular vertical orientation of said panels is structured to define a rearwardly sloped configuration of said wall section relative to an oncoming movement of said wave of fluid.

9. An erosion retardation structure as recited in claim 1 wherein said predetermined angular vertical orientation relative to said horizontal plane of the underlying granular base is generally between about 55–85 degrees.

10. An erosion retardation structure as recited in claim 1 wherein said predetermined angular orientation of said panels relative to one another is generally between about 75–115 degrees.

11. An erosion retardation structure as recited in claim 1 further comprising a flange assembly disposed on said panels at generally an upper edge of said wall section, said flange assembly structured to further disrupt a flow of said wave of fluid over said wall section, thereby further promoting said deposit of granular material by said wave of fluid in generally adjacent proximity to said panels.

12. An erosion retardation structure as recited in claim 11 further comprising a flange assembly disposed on said panels at generally a lower edge of said wall section, said flange assembly structured to further maintain said panels on the underlying granular base.

13. An erosion retardation structure as recited in claim 1 further comprising a support assembly structured to reinforce said predetermined angular vertical orientation of said panels under a continuing engagement of said wave of fluid on said wall section.

14. An erosion retardation structure as recited in claim 13 wherein said support assembly comprises a rigid rod extending along said panel and into the underlying granular base.

15. An erosion retardation structure as recited in claim 13 wherein said support assembly comprises a quantity of granular material disposed in adjacent, abutting engagement between a rear face of said wall section and the underlying granular base.

16. An erosion retardation structure as recited in claim 1 wherein said panels are formed of sheet metal.

17. An erosion retardation structure as recited in claim 1 wherein said panels are formed of concrete.

18. An erosion retardation structure as recited in claim 17 wherein said coupling assembly includes a molded joint, and said panels are substantially integrally formed with one another.

* * * * *